US010392816B2

(12) United States Patent
Chang

(10) Patent No.: US 10,392,816 B2
(45) Date of Patent: Aug. 27, 2019

(54) LEVELING DEVICE FOR PLANAR OBJECTS

(71) Applicant: Jason Chang, Taichung (TW)

(72) Inventor: Jason Chang, Taichung (TW)

( * ) Notice: Subject to any disclaimer, the term of this patent is extended or adjusted under 35 U.S.C. 154(b) by 189 days.

(21) Appl. No.: 15/723,171

(22) Filed: Oct. 3, 2017

(65) Prior Publication Data

US 2019/0100926 A1 Apr. 4, 2019

(51) Int. Cl.

| | |
|---|---|
| ***G01B 5/14*** | (2006.01) |
| ***E04F 21/00*** | (2006.01) |
| ***E04F 15/02*** | (2006.01) |
| ***E04F 21/20*** | (2006.01) |

(52) U.S. Cl.

CPC .... *E04F 21/0092* (2013.01); *E04F 15/02022* (2013.01); *E04F 21/20* (2013.01)

(58) Field of Classification Search

CPC ..... E04F 21/0092
USPC ..... 33/526, 527
See application file for complete search history.

(56) References Cited

U.S. PATENT DOCUMENTS 4,397,125 A * 8/1983 Gussler, Jr. ..... E04F 21/0092 52/127.3
5,560,117 A * 10/1996 Tallman ..... E01C 9/086 33/526
8,429,879 B1 * 4/2013 Hoffman ..... E04F 21/0092 52/747.11
8,635,815 B2 * 1/2014 Bordin ..... E04F 15/02022 33/526
9,322,186 B1 * 4/2016 Chang ..... E04F 21/0092
9,470,003 B1 * 10/2016 Moon ..... E04F 21/0092
2004/0060184 A1 * 4/2004 Shilo ..... E04F 21/0092 33/526
2010/0263304 A1 * 10/2010 Torrents I Comas ..... E04F 21/0092 52/126.5
2014/0325936 A1 * 11/2014 PSaila ..... E04F 21/1877 52/749.11
2016/0222679 A1 * 8/2016 Bunch ..... E04F 21/1844
2017/0044779 A1 * 2/2017 Teng ..... E04F 21/1877
2017/0211282 A1 * 7/2017 Teng ..... E04F 21/0092
2018/0355623 A1 * 12/2018 Frisco ..... E04F 21/0092
2019/0093372 A1 * 3/2019 Russo ..... E04F 21/0092

* cited by examiner

*Primary Examiner* — George B Bennett

(57) ABSTRACT

A leveling device for planar objects includes a first part having a circular end hole, a chamber, a flange, a handle, a contact portion, two blades and a bottom face. A second part includes a receiving hole, a first shoulder, two recesses, a slot, a mark, an axial hole and a second shoulder. The first and second parts are connected to each other. A movable member movably inserted into the first and second parts. The movable member includes a push potion, a middle section, a lower section and a room. An engaging member is securely inserted into the room and has a lower portion extending beyond the movable member. The engaging member is movable with the movable member. A resilient member is mounted to the lower section and biased between the middle section and the second shoulder.

12 Claims, 15 Drawing Sheets

LEVELING DEVICE FOR PLANAR OBJECTS

BACKGROUND OF THE INVENTION

1. Fields of the Invention

The present invention relates to a leveling device, and more particularly, to a leveling device for planar objects and the like.

2. Descriptions of Related Art

The conventional tile leveling devices known to applicant are disclosed in U.S. Pat. Nos. 9,470,003 and 9,322,186. The U.S. Pat. No. 9,470,003 comprises a spool which includes a pressure plate, a flanged end, a nipple sleeve and an axial passage. A separation portion is located between the pressure plate and the flanged end. The flanged end is located between the separation portion and the nipple sleeve. A T-shaped handle extends through the axial passage and includes opposed blades 14 and a threaded portion 47 on two ends thereof. The threaded portion is exposed beyond the spool. A handle is connected to the threaded portion. A coil spring is mounted to the nipple sleeve, the shaft and the handle, and biased between the handle and the flanged end. The alignment device is located between the two tiles, and the gap is located corresponding to the gap between the two tiles. When pushing the handle to compress the coil spring, the blades extend through the gap, and when the alignment device is rotated 90 degrees, the blades are in contact to the undersides of the two tiles, so that the two tiles re in flush with each other.

The shortcomings of the U.S. Pat. No. 9,470,003 are that the coil spring 24 is mounted to the nipple sleeve 37, the shaft 12 and the handle 26, and is exposed beyond the alignment device 10. This arrangement does not meet aesthetic purposes. Besides, the coil spring located beyond the alignment device easily gets dust or paint, and is difficult to be cleaned up. The shaft is a T-shaped handle which enters into the gap in the horizontal direction, and then is rotated 90 degrees, and the blades 14 are in contact with the underside of the tiles. Because there is no proper marks to check the whether or not the blades are rotated 90 degrees. Furthermore, the shaft extends through the axial passage, and the threaded portion is located outside of the spool 30 and connected to the threaded portion, so that when the handle is rotated upward along the threaded portion, the threaded portion is exposed beyond the handle and the spool, and is easily get rusted.

The U.S. Pat. No. 9,322,186 discloses a leveling spacer system and comprises a plurality of panel members, multiple spacers, multiple plates and multiple knobs. The U.S. Pat. No. 9,322,186 does not have any coil spring so that the cleaning concerns are not existed, and the leveling spacer system looks neat when compared with the U.S. Pat. No. 9,470,003. However, the shortcomings are that the U.S. Pat. No. 9,322,186 includes two parts and each of which includes inner threads, and the number of the parts can easily reach to at least one thousand. In other words, the workers have to threading the two parts together over one thousand times. The threading actions require a lot of time and labor cost.

The present invention intends to provide a leveling device for planar objects and the shortcomings mentioned above are eliminated.

SUMMARY OF THE INVENTION

The present invention relates to a leveling device for planar objects and comprises a first part having a circular end hole, a chamber, a flange, a handle, a contact portion, two blades and a bottom face. A second part includes a receiving hole, a first shoulder, two recesses, a slot, a mark, an axial hole and a second shoulder. The first and second parts are connected to each other. A movable member movably inserted into the first and second parts. The movable member includes a push potion, a middle section, a lower section and a room. An engaging member is securely inserted into the room and has a lower portion extending beyond the movable member. The engaging member is movable with the movable member. A resilient member is mounted to the lower section and biased between the middle section and the second shoulder.

The resilient member is located in the chamber and the slot, and hidden in the first and second parts so that the whole leveling device is neat and does not get dust and dirt. The engaging member is fixed to the movable member, and a portion of the engaging member extends beyond the movable member and located within the second part. Foreign objects do not attach to the portion of the engaging member which is not bent or deformed by foreign objects. The blades of the engaging member are inserted through the gap between the planar objects when pushing the movable member. This action is easy and saves workers' time.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
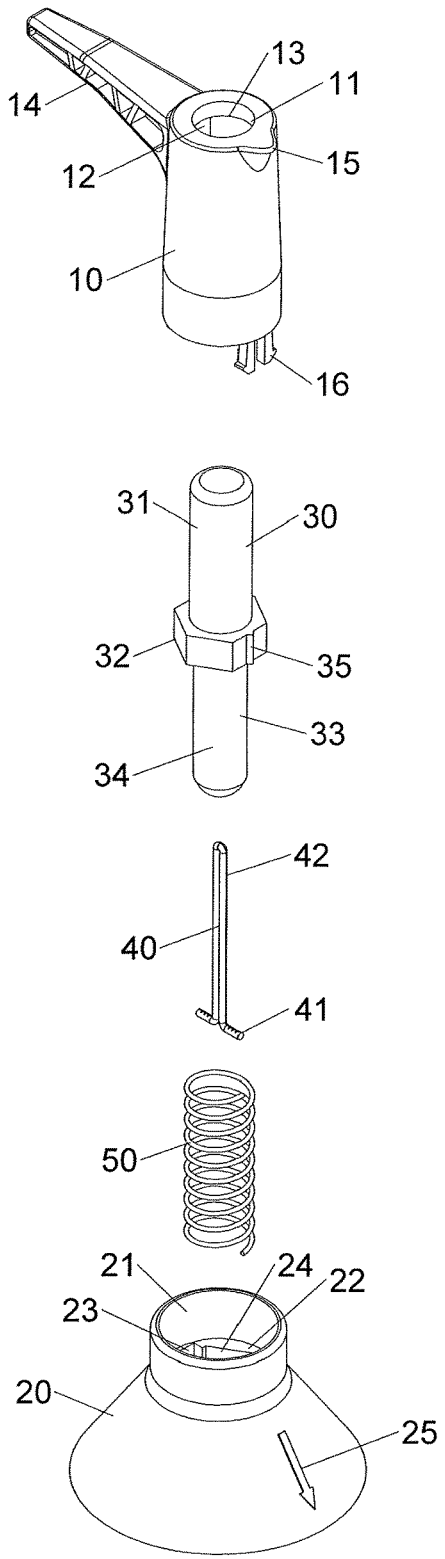
FIG. 1 is an exploded view of the leveling device of the present invention.
Figure 3:
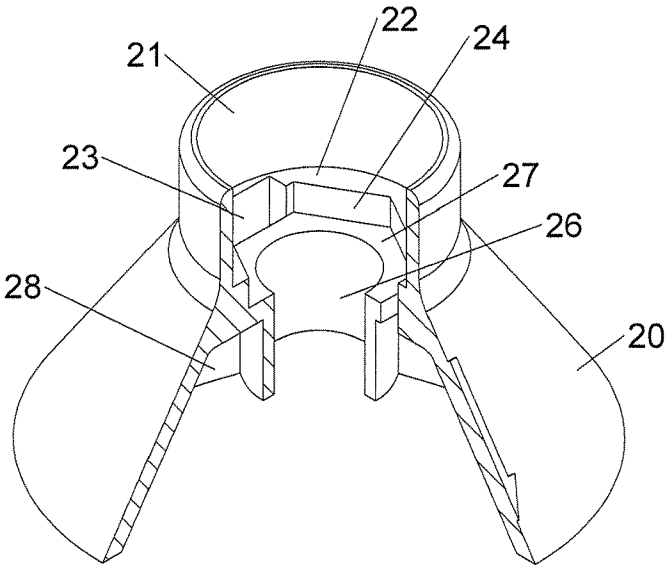
FIG. 3 is a cross sectional view, partially removed, of the second part of the leveling device of the present invention.
Figure 2:
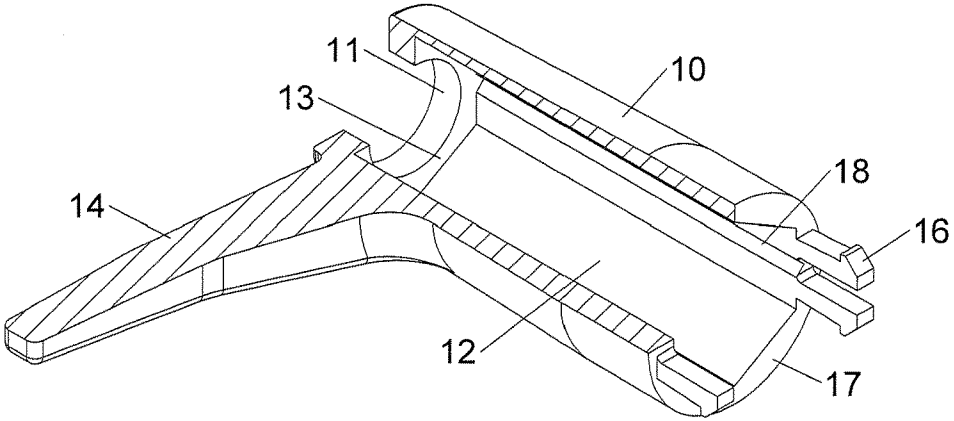
FIG. 2 is a cross sectional view, partially removed, of the first part of the leveling device of the present invention.
Figure 4:
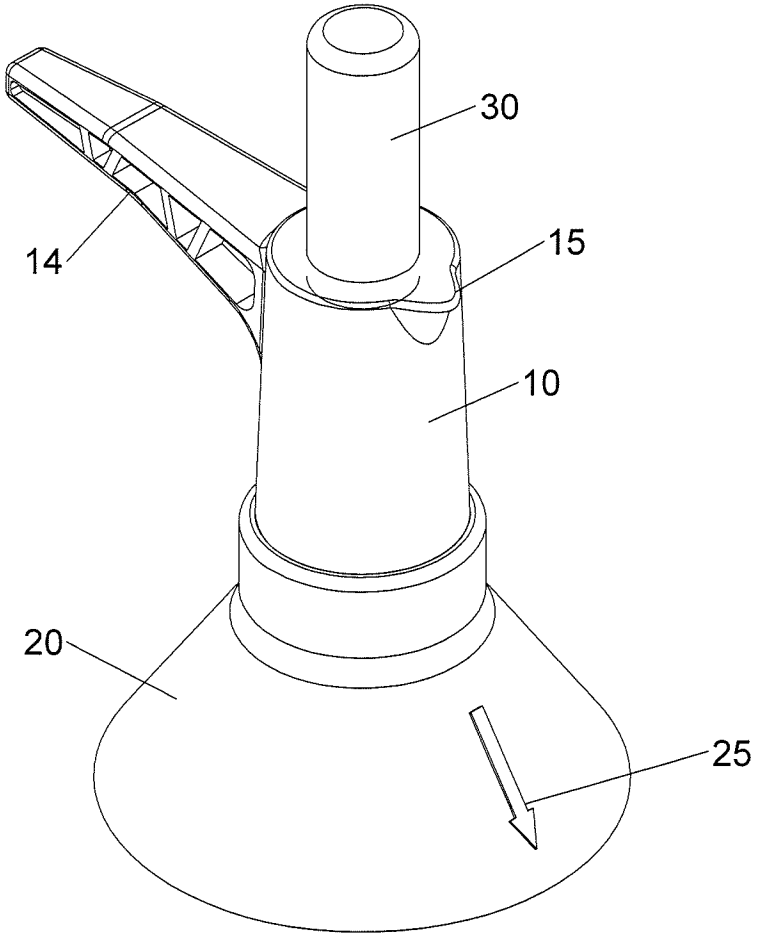
FIG. 4 is a perspective view to show the leveling device of the present invention.
Figure 6:
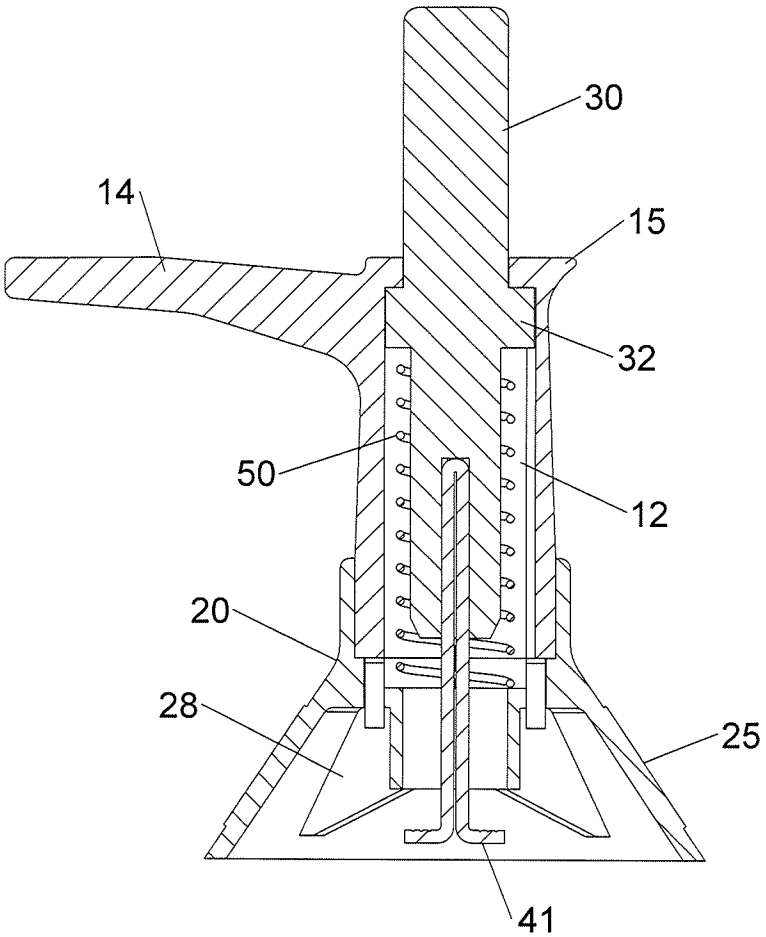
FIG. 6 is a cross sectional view, taken along line 6-6 in FIG. 5.
Figure 5:
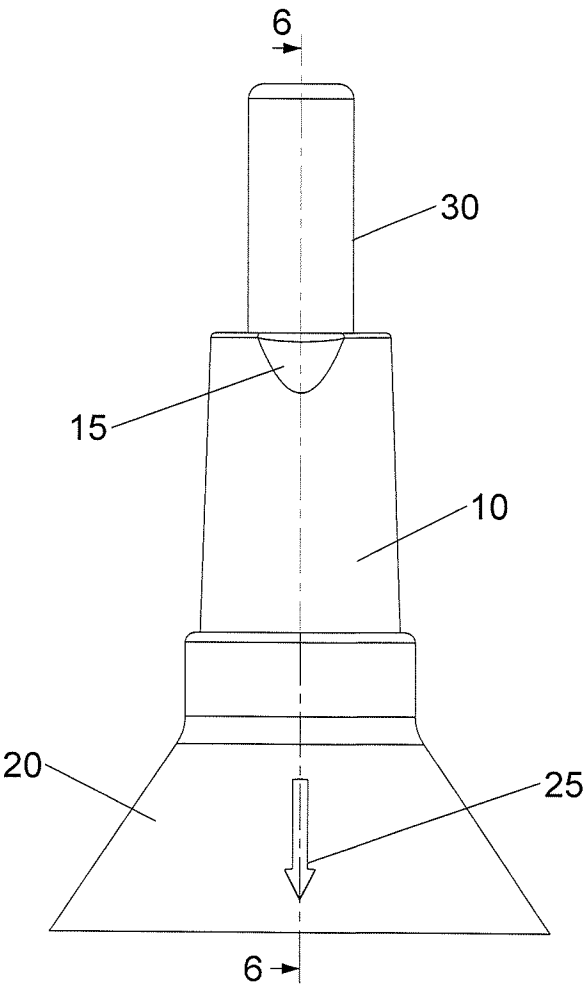
FIG. 5 is a side view to show the leveling device of the present invention.

Referring to FIGS. 1 to 6, the leveling device of the present invention is used to fix planar objects 60, such as tiles, thin boards or the like, to a flat surface such as a wall of floor, and the leveling device comprises a first part 10 which comprises a circular end hole 11 defined in the top thereof, and a hexagonal chamber 12 is defined through the top and the bottom of the first part 10. The chamber 12 communicates with the end hole 11 and has a flange 13 extending inward from the inner periphery thereof. The first part 10 includes a handle 14 and a contact portion 15 respectively and diametrically formed on outside thereof. When a user holds the handle 14, one of his fingers can contact at the contact portion 15 so as to conveniently operate the leveling device. Two hooks 16 extend from the bottom face 17 of the first part 10. The chamber 12 includes a V-shaped groove 18 defined therein. A second part 20 has a circular receiving hole 21 defined in the top thereof, and a lower portion of the first part 10 is received in the receiving hole 21. A first shoulder 22 extends from the inner periphery of the receiving hole 21, so that the bottom face 17 of the first part 10 is rested on the first shoulder 22. Two recesses 23 are defined in the inner periphery of the receiving hole 21 and communicate with the receiving hole 21. The two hooks 16 are hooked with the recesses 23 so that the first and second parts 10, 20 are connected to each other. The second part 20 has a hexagonal slot 24 defined radially therein, and the slot 24 communicates with the chamber 12. An axial hole 26 is defined axially therein. The slot 24 communicates with the chamber 12, the receiving hole 21 and the recesses 23. A mark 25 is formed on the outside of the second part 20. The handle 14 and the contact portion 15 are located on a straight line that extends along the direction of the mark 25. The axial hole 26 communicates with the end hole 11. The slot 24 is located between the receiving hole 21 and the axial hole 26. A second shoulder 27 is formed between the slot 24 and the axial hole 26. The second part 20 includes multiple ribs 28 located therein.

A movable member 30 movably extends through the first and second parts 10, 20, and has a push potion 31 on the upper portion thereof and a lower section 33 on the lower portion thereof. A middle section 32 extends from the movable member 30 and located between the push portion 31 and the lower section 33. The push portion 31 movably extends through the chamber 12 and protrudes beyond the top of the first part via the end hole 11, so that the users can push the push portion 31. The shape of the middle section 32 is shaped to be movable in the chamber 12 of the first part 10. A room 34 is defined in the lower end of the lower section 33. The lower section 33 is movable in the chamber 12, the slot 24 and the axial hole 26. The middle section 32 has a protrusion 35 extending therefrom, and the protrusion 35 is movably engaged with the V-shaped groove 18.

An engaging member 40 is securely inserted into the room 34 and has a lower portion extending beyond the lower end of the movable member 30. The lower portion is located in the second part 20. Two blades 41 extend perpendicularly from the lower portion of the engaging member 40. The two blades 41 are exposed beyond the lower portion of the engaging member 40 and extend along the direction identical to the direction that the mark 25 extends. The engaging member 40 has an upper portion 42 which is fixed in the room 34. The engaging member 40 is put in the molding set of the movable member 30 so that when the movable member 30 is made by way of injection molding, the engaging member 40 is integrally formed with the movable member 30.

A resilient member 50 is mounted to the lower section 33 and biased between the middle section 32 of the movable member 30 and the second shoulder 27 of the second part 20. The middle portion 32 contacts the underside of the flange 13 by the resilient member 50.

Figure 7:
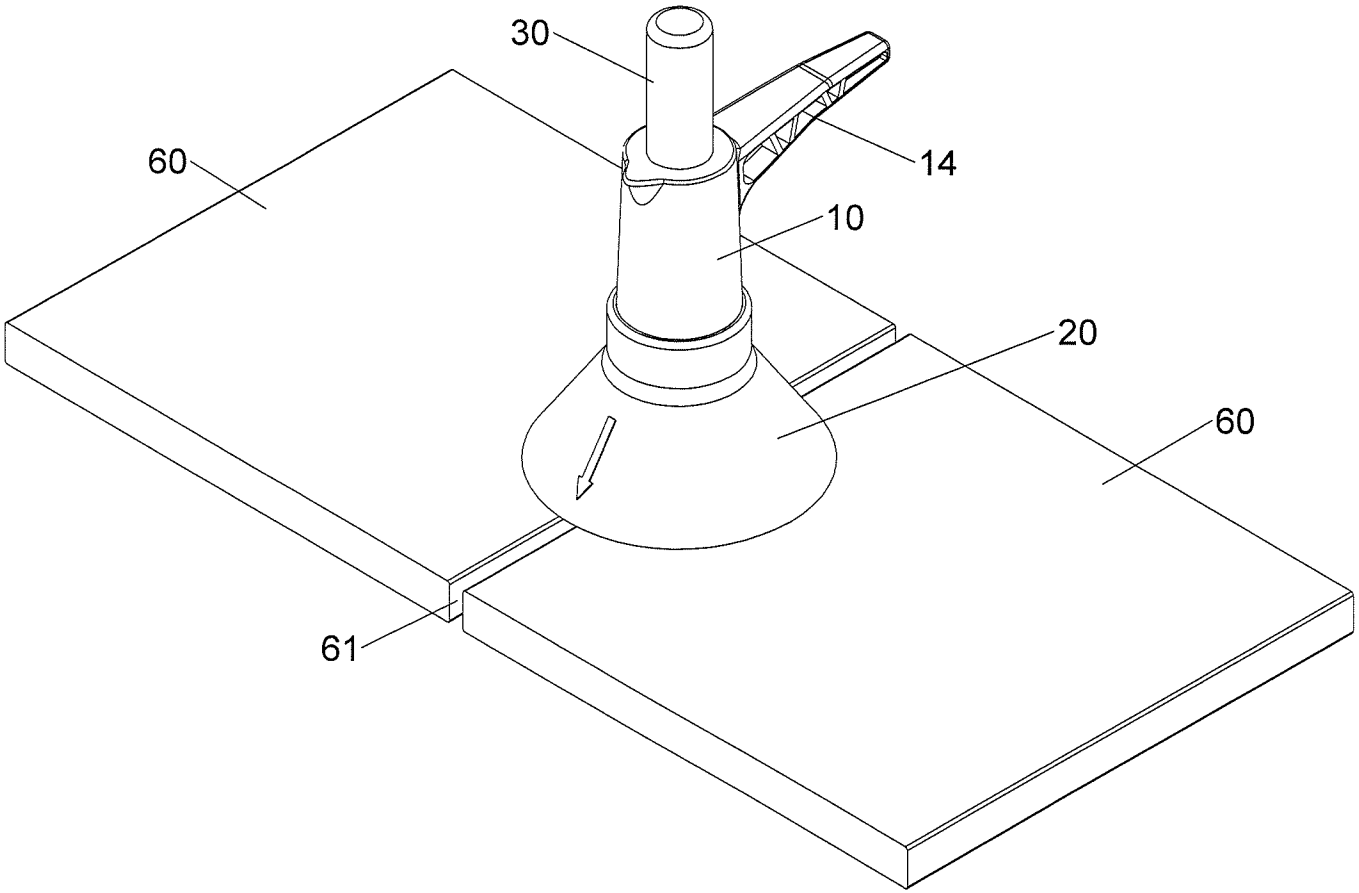
FIG. 7 shows that the leveling device of the present invention is put across two planar objects.
Figure 8:
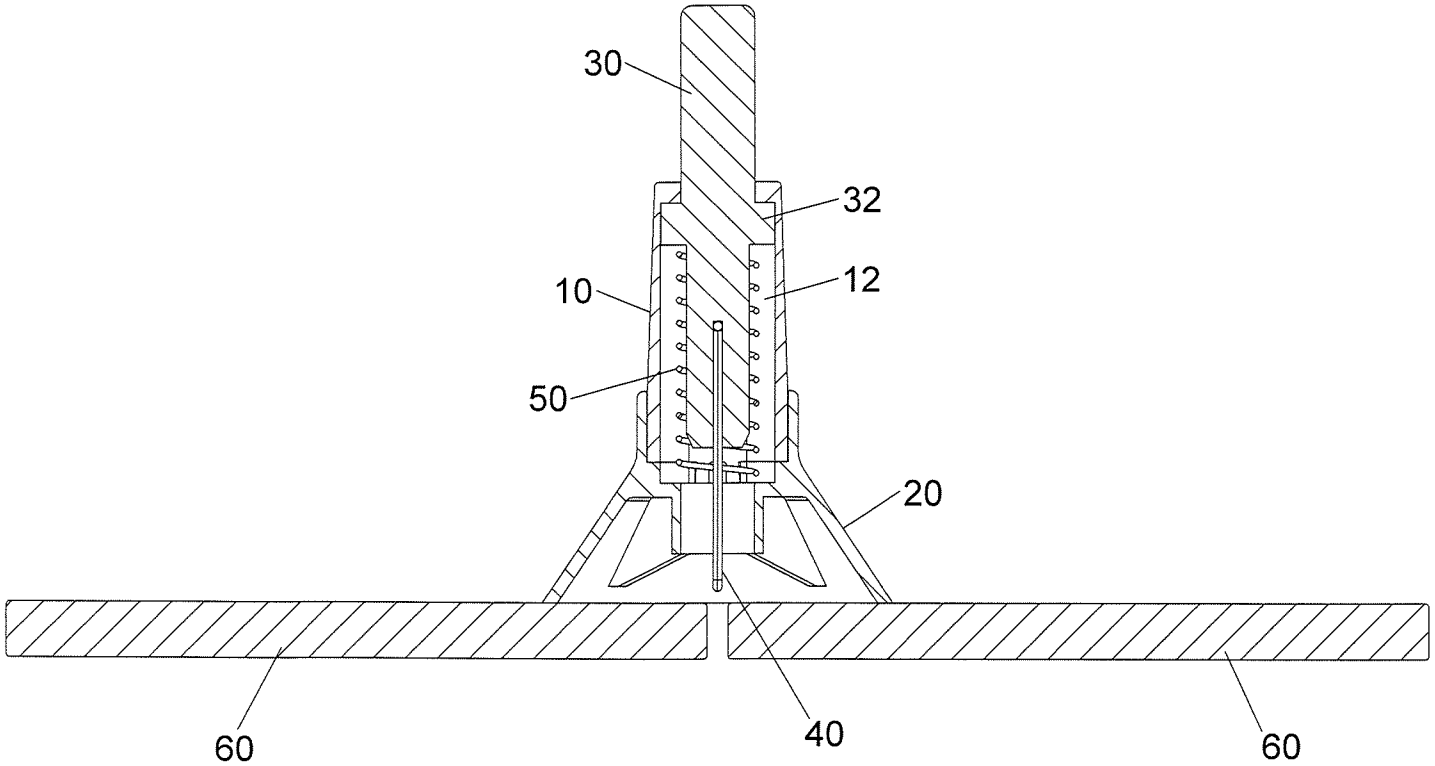
FIG. 8 is a cross sectional view of the disclosure of FIG. 7.
Figure 9:
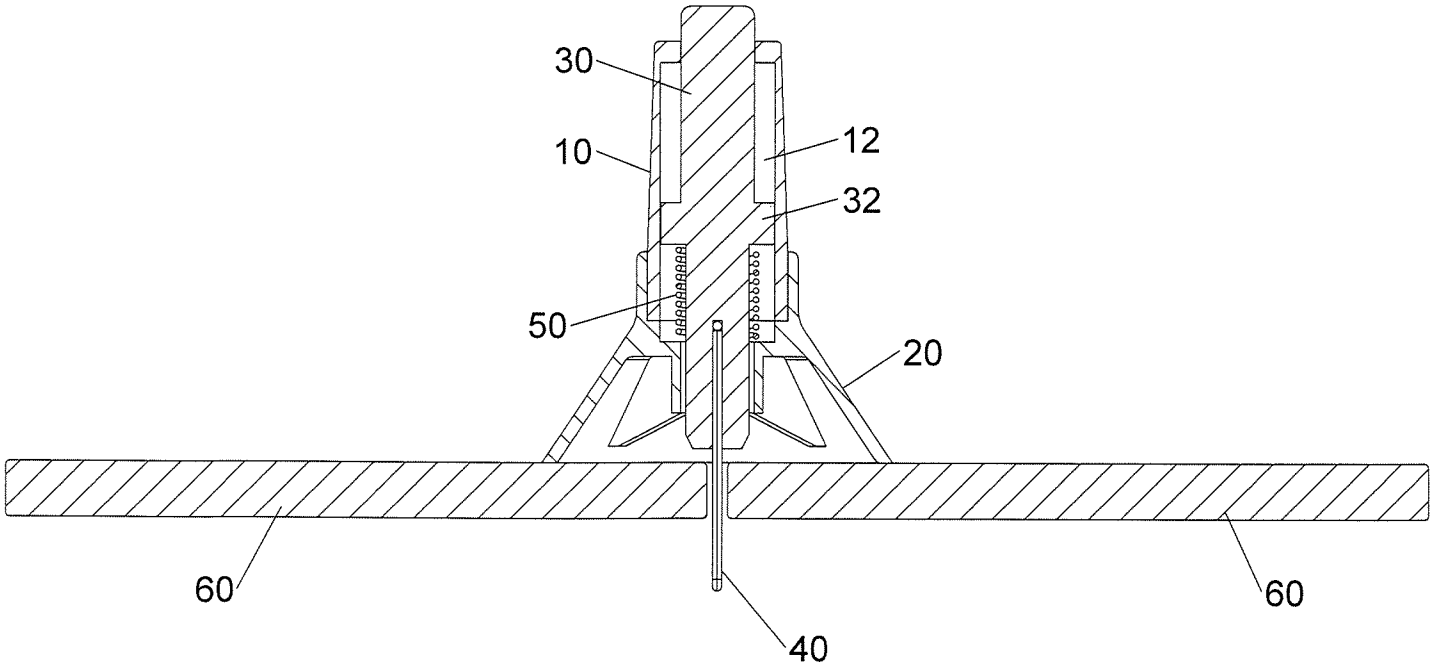
FIG. 9 is a cross sectional view to show that the movable member is pushed downward and the blades extends through the gap between the two planar objects.
Figure 10:
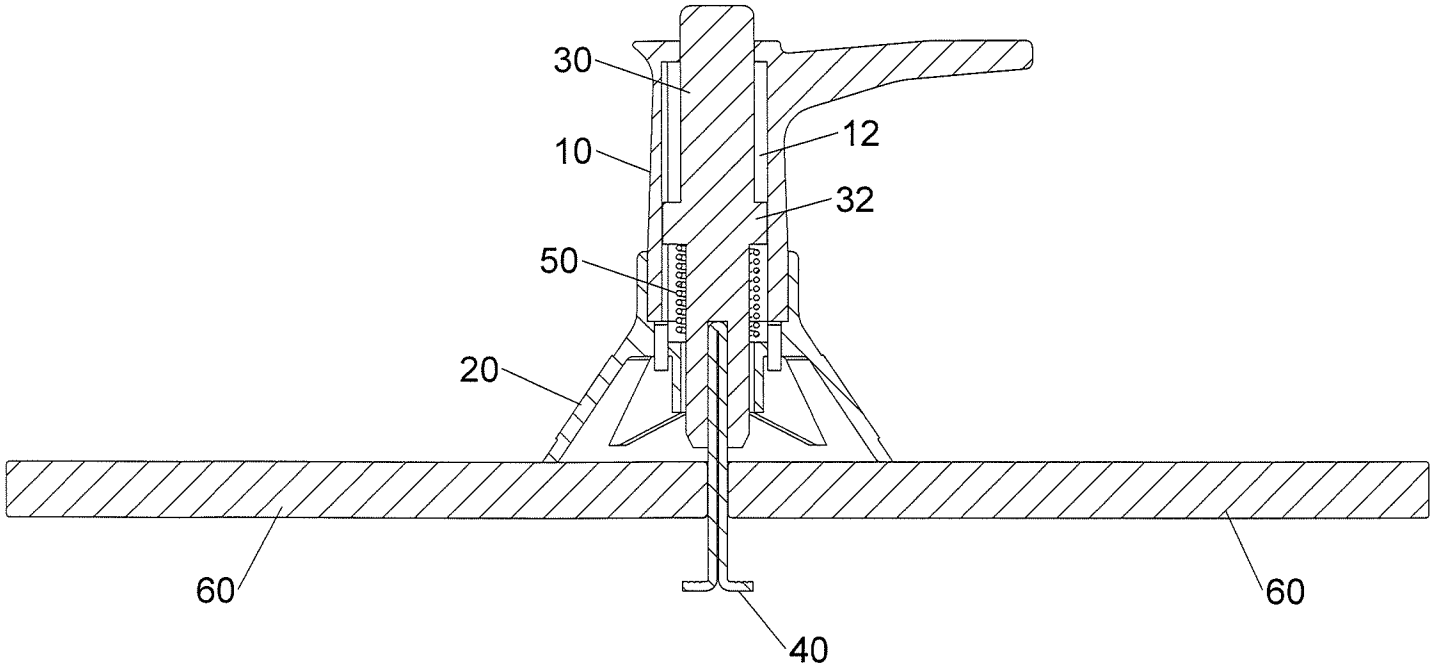
FIG. 10 is a cross sectional view to show that the movable member is rotated.
Figure 11:
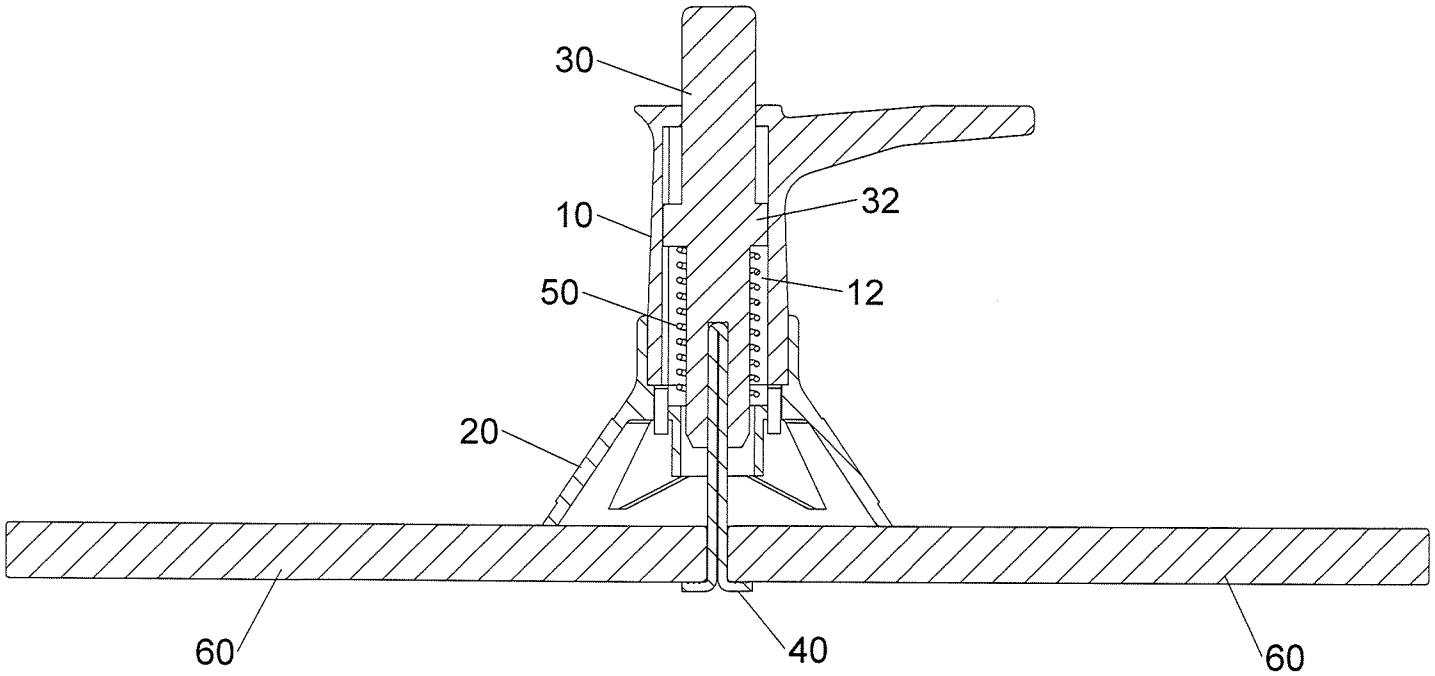
FIG. 11 is a cross sectional view to show that the movable member bounces upward and the blades contacts the undersides of the two planar objects.

As shown in FIGS. 7 and 8, a gap 61 is formed between two adjacent planar objects 60. The leveling device is put across the two planar objects 60, and the contact portion 15 and the mark 25 are located corresponding to the gap 61. The blades 41 are located corresponding to the gap 61. As shown in FIG. 9, when the push portion 31 is pushed downward, the middle section 32 is lowered to compress the resilient member 50, the movable member 30 and the engaging member 40 are moved downward. The engaging member 40 extends through the gap 61 and the blades 41 are located below the two respective undersides of the two planar objects 60. As shown in FIGS. 10 and 11, when the user holds the handle 14 and rotates 90 degrees, the engaging member 40 is also rotated 90 degrees. The blades 41 are rotated and located at the undersides of the two planar objects 60. The mark 25 is removed from the gap 61 and points the planar object 60, and the blades 61 are perpendicular to the gap 61. When the push portion 31 is released, the resilient member 50 pushes the movable member 30 and the engaging member 40 upward, and the blades 41 contact the undersides of the two planar objects 60.

Figure 12:
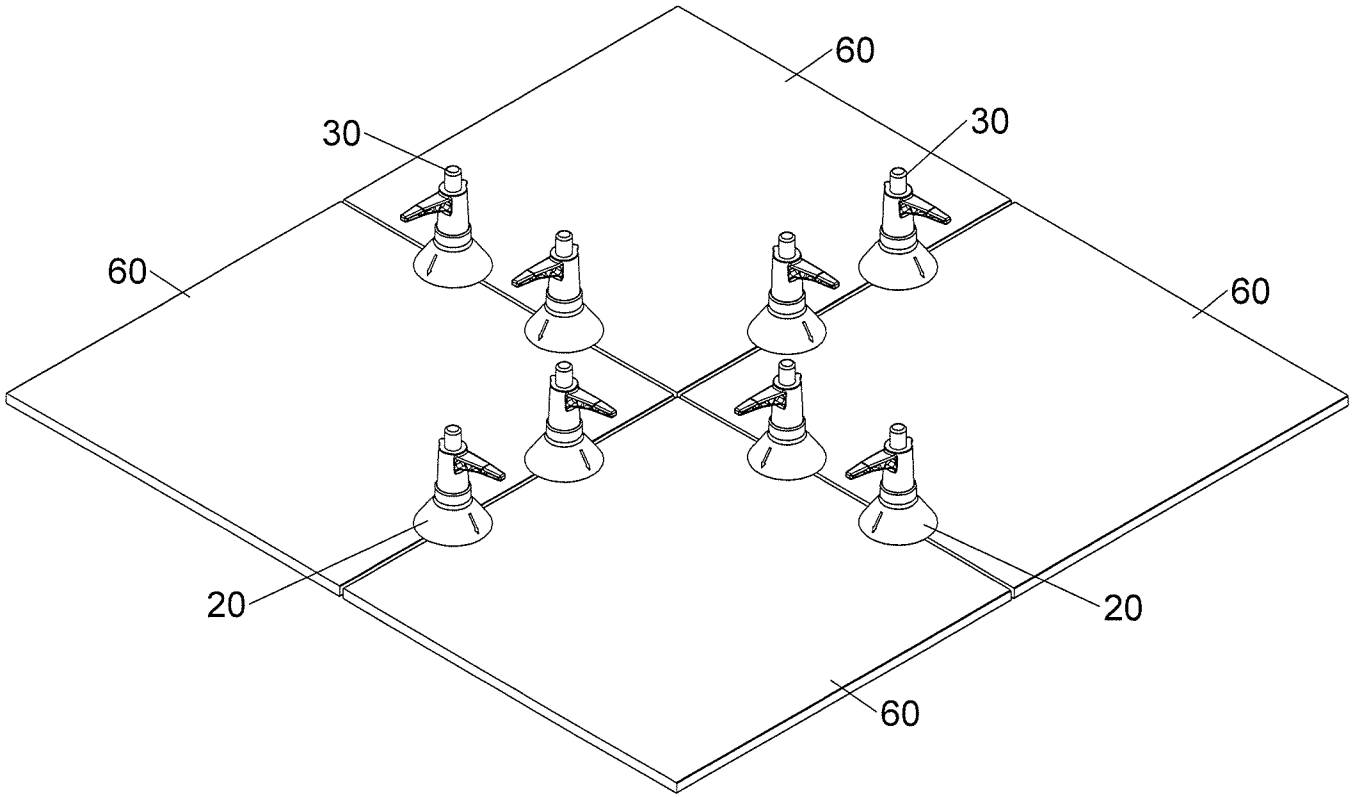
FIG. 12 shows that multiple leveling devices of the present invention are used for leveling planar objects.

As shown in FIG. 12, the planar objects 60 are aligned along the first direction and the second direction, the leveling device is put across the planar objects and located corresponding to the gaps 61 in each of the first and second directions to level the planar objects 60.

Figure 13:
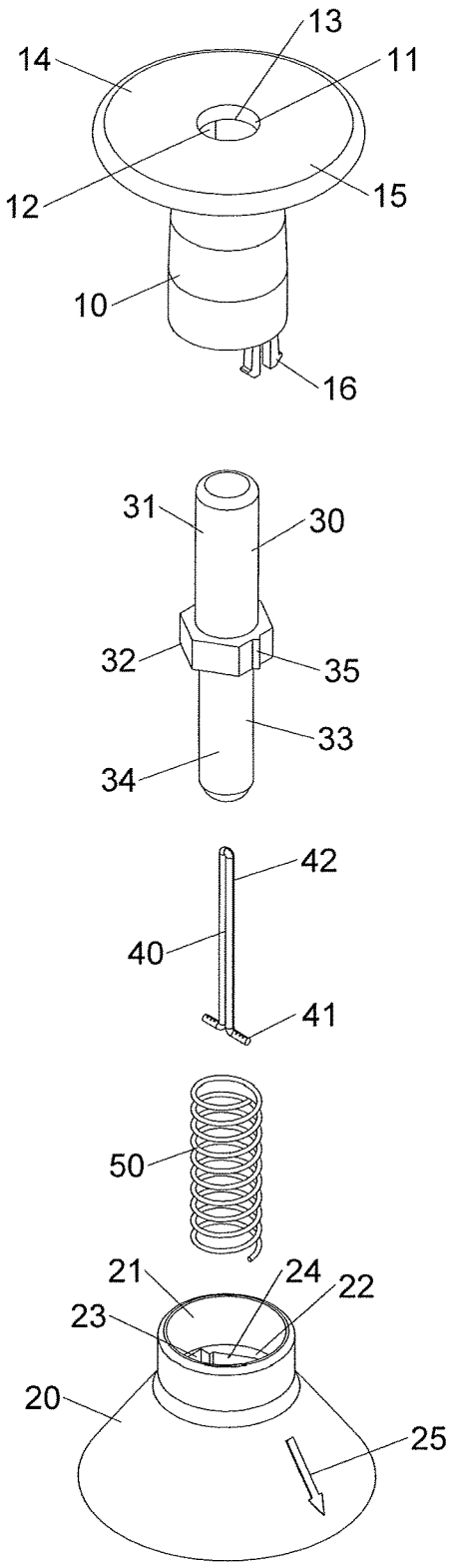
FIG. 13 is an exploded view of the second embodiment of the leveling device of the present invention.

As shown in FIG. 13, the handle 14 and the contact portion 15 are formed as a circular disk.

Figure 14:
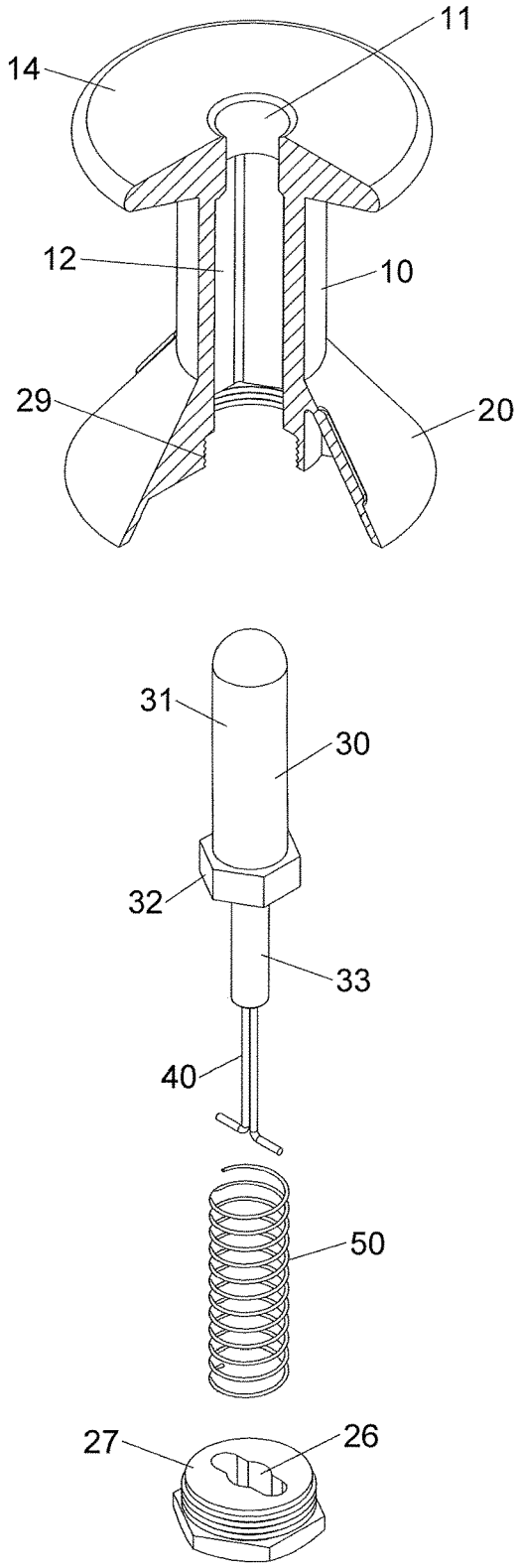
FIG. 14 is an exploded view of the third embodiment of the leveling device of the present invention.
Figure 16:
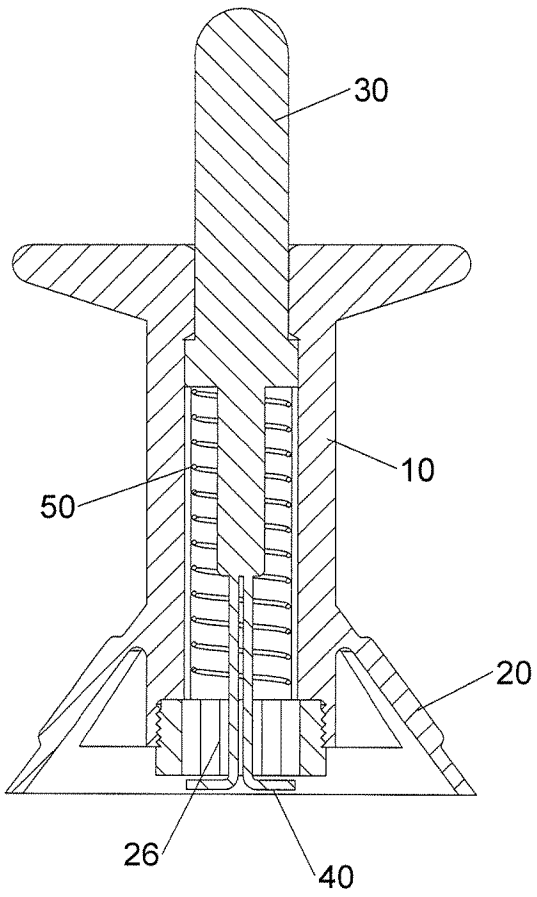
FIG. 16 is a cross sectional view, taken along line 16-16 in FIG. 15.
Figure 15:
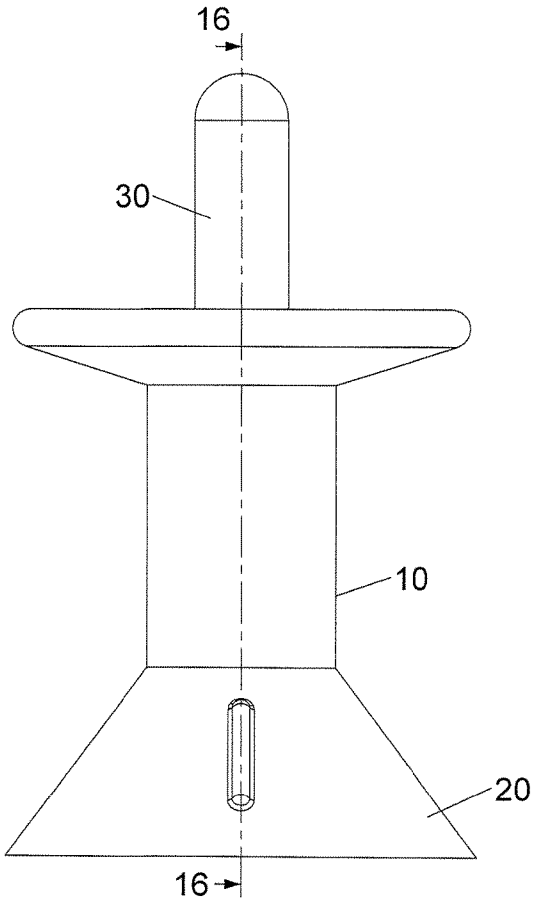
FIG. 15 is a side view of the third embodiment of the leveling device of the present invention.

As shown in FIGS. 14 to 16, the first and second parts 10, 20 are an integrally formed as one piece. The axial hole 26 and the second shoulder 27 are formed as a first member which includes outer threads. The axial hole 26 is defined through the center of the first member. The second shoulder 27 is located on the top of the first member. The slot 24 includes inner threads 29 to which the outer threads of the first member is connected. The movable member 30 and the engaging member 40 are formed as one piece. The engaging member 40 extends through the chamber 12 and the axial hole 26. The blades 41 are exposed beyond the axial hole 26. The resilient member 50 is located in the chamber 12 and mounted to the lower section 33 and the engaging member 40. The resilient member 50 is biased between the middle section 32 and the second shoulder 27.

Figure 17:
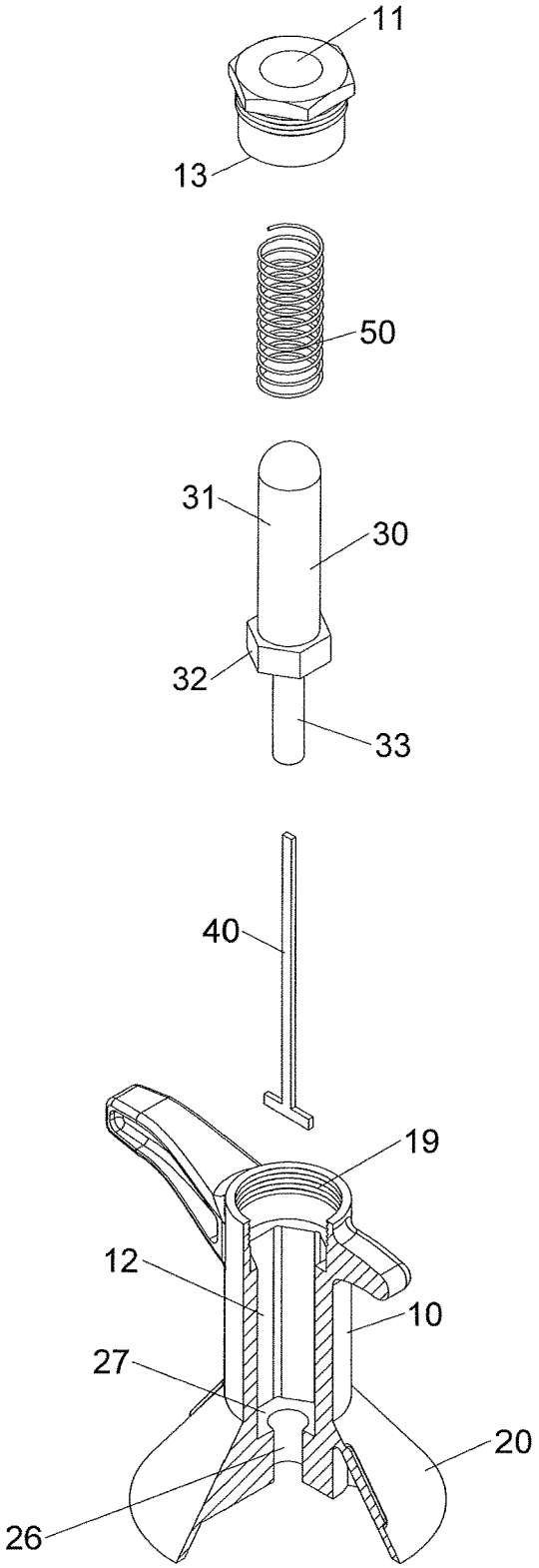
FIG. 17 is an exploded view of the fourth embodiment of the leveling device of the present invention.
Figure 19:
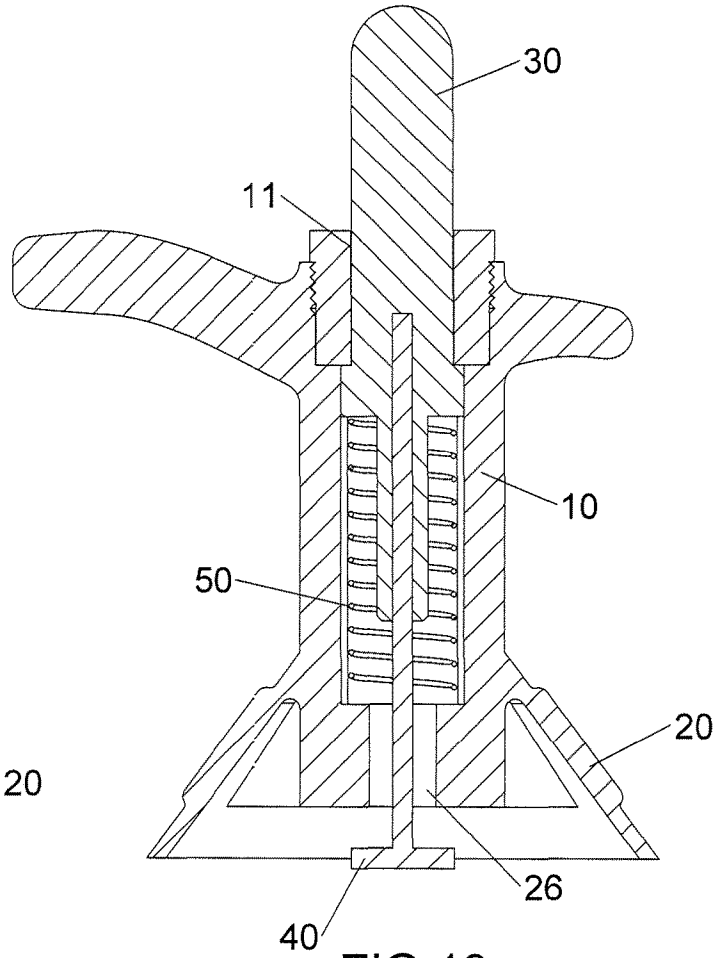
FIG. 19 is a cross sectional view, taken along line 19-19 in FIG. 18.
Figure 18:
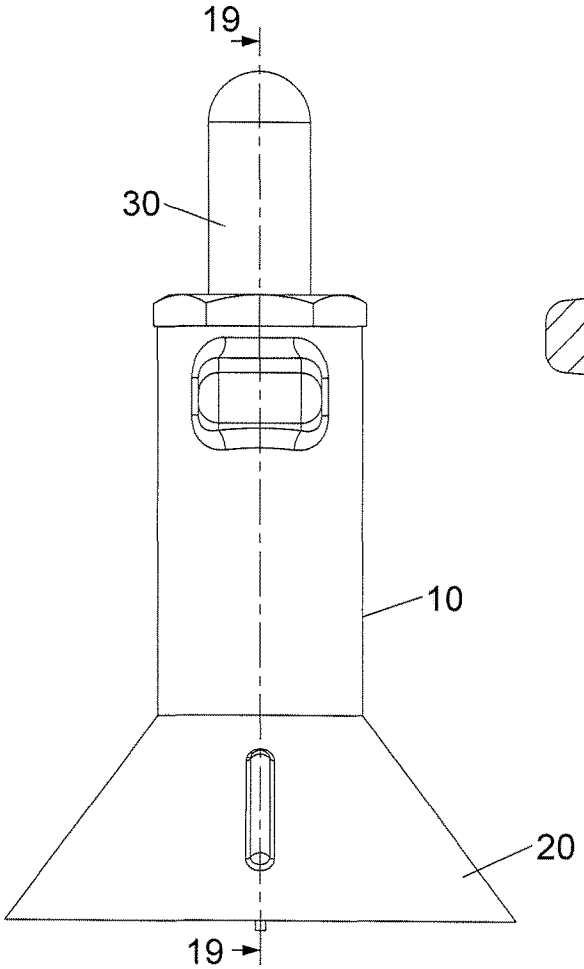
FIG. 18 is a side view of the fourth embodiment of the leveling device of the present invention.

As shown in FIGS. 17 to 19, the first and second parts 10, 20 are an integrally formed as one piece. The end hole 11 and the flange 13 are formed as a second member. The end hole 11 is defined through the second member. The flange 13 is located at the underside of the second member. The first part 10 includes inner threads 19 in the open top thereof. The second member is connected to the inner threads 19 to be connected to the first part 10. The end hole 11 communicates with the chamber 12. The movable member 30 extends through the end hole 11 and the chamber 12. The push portion 31 is exposed beyond the end hole 11. The middle section 32 contacts the flange 13. The engaging member 40 extends through the chamber 12 and the axial hole 26. The blades 41 are exposed beyond the axial hole 26. The resilient member 50 is located in the chamber 12 and mounted to the lower section 33 and the engaging member 40. The resilient member 50 is biased between the middle section 32 and the second shoulder 27. The middle section 32 is pushed by the resilient member 50 and contacts the flange 13.

The advantages of the present invention are that the resilient member 50 is located in the chamber 12 and the slot 24, and hidden in the first and second parts 10, 20 so that the whole leveling device is neat and does not get dust and dirt.

The engaging member 40 is fixed to the movable member 30, and a portion of the engaging member 40 extends beyond the movable member 30 and is located within the second part 20 so that foreign objects cannot access the portion of the engaging member 40.

The blades 41 of the engaging member 40 are inserted through the gap 61 between the planar objects 60 when pushing the movable member 30. This action is easy and saves workers' time.

The mark 25 is located in alignment with the handle 14 and the contact portion 15, and the blades 41 extend in the direction that is identical with that of the handle 14, the contact portion 15 and the mark 25. When the leveling device is located between the two planar objects 60, the contact portion 15 and the mark 25 are aligned with the gap 61, and the blades 41 are located corresponding to the gap 61. The handle 14 and the mark 25 help the users to correctly and quickly set the leveling devices.

While we have shown and described the embodiment in accordance with the present invention, it should be clear to those skilled in the art that further embodiments may be made without departing from the scope of the present invention.

What is claimed is:

1. A leveling device for planar objects, the planar objects being fixed to a flat surface, and the leveling device comprising:

a first part having a circular end hole defined in a top thereof, a chamber defined through the top and a bottom of the first part, the chamber communicating with the end hole and having a flange extending inward from an inner periphery thereof, two hooks extending from a bottom face of the first part;

a second part having a circular receiving hole defined in a top thereof, a lower portion of the first part received in the receiving hole, a first shoulder extending from an inner periphery of the receiving hole, the bottom face of the first part rested on the first shoulder, two recesses defined in the inner periphery of the receiving hole and the two hooks being hooked with the recesses so that the first and second parts are connected to each other, the second part having a slot defined radially therein, and an axial hole defined axially therein, the slot communicating with the chamber and the recesses, a mark formed on an outside of the second part, the axial hole communicating with the end hole, the slot located between the receiving hole and the axial hole, a second shoulder formed between the slot and the axial hole;

a movable member having a push potion on an upper portion thereof and a lower section on a lower portion thereof, a middle section extending from the movable member and located between the push portion and the lower section, the push portion movably extending through the chamber and protruding beyond the top of the first part via the end hole, a shape of the middle section being shaped to be movable in the chamber of the first part, a room defined in a lower end of the lower section;

an engaging member securely inserted into the room and having a lower portion extending beyond the lower end of the movable member, the lower portion located in the second part, two blades extending perpendicularly from the lower portion of the engaging member, the two blades exposed beyond the lower portion of the engaging member and extending along a direction identical to a direction that the mark extends, the engaging member having an upper portion which is fixed in the room, and a resilient member mounted to the lower section and biased between the middle section of the movable member and the second shoulder of the second part, the middle portion contacting an underside of the flange by the resilient member.

2. The leveling device for planar objects as claimed in claim 1, wherein the chamber is a hexagonal or polygonal chamber, the slot is a hexagonal slot, the middle section is a hexagonal section.

3. The leveling device for planar objects as claimed in claim 1, wherein the first part includes a handle and a contact portion respectively and diametrically formed on outside thereof, the handle and the contact portion are located on a straight line that extends along the direction of the mark.

4. The leveling device for planar objects as claimed in claim 3, wherein the handle and the contact portion are formed as a circular disk.

5. The leveling device for planar objects as claimed in claim 3, wherein a gap is formed between two adjacent planar objects, the contact portion and the mark are located corresponding to the gap, the blades are located corresponding to the gap, when the push portion is pushed downward, the middle section is lowered to compress the resilient member, the movable member and the engaging member are moved downward, the engaging member extends through the gap, when the engaging member is rotated 90 degrees, the blades are rotated and located at two respective undersides of the two planar objects, the mark is removed from the gap and points the planar object, the blades are perpendicular to the gap, when the push portion is released, the resilient member pushes the movable member and the engaging member upward, the blades contact the undersides of the two planar objects.

6. The leveling device for planar objects as claimed in claim 1, wherein the chamber includes a V-shaped groove defined therein, the middle section has a protrusion extending therefrom, the protrusion is movably engaged with the V-shaped groove.

7. The leveling device for planar objects as claimed in claim 1, wherein the mark is shaped as an arrow head.

8. The leveling device for planar objects as claimed in claim 1, wherein the second part includes multiple ribs located therein.

9. The leveling device for planar objects as claimed in claim 1, wherein the engaging member is integrally formed with the movable member.

10. The leveling device for planar objects as claimed in claim 1, wherein the first and second parts are an integrally formed as one piece, the axial hole and the second shoulder are formed as a first member which includes outer threads, the axial hole is defined through a center of the first member, the second shoulder is located on a top of the first member, the slot includes inner threads to which the outer threads of the first member is connected.

11. The leveling device for planar objects as claimed in claim 1, wherein the movable member and the engaging member are formed as one piece.

12. The leveling device for planar objects as claimed in claim 1, wherein the first and second parts are an integrally formed as one piece, the end hole and the flange are formed as a second member, the end hole is defined through the second member, the flange is located at an underside of the second member, the first part includes inner threads in an open top thereof, the second member is connected to the inner threads to be connected to the first part, the end hole communicates with the chamber.

* * * * *